US005261331A

United States Patent [19]

Baudin

[11] Patent Number: 5,261,331

[45] Date of Patent: Nov. 16, 1993

[54] PROPULSION DEVICE FOR A TRAIN INTENDED FOR RENEWAL OF RAILWAY TRACKS UTILIZING RAIL GRIPPERS TO SUPPLY PROPULSION THRUST

[75] Inventor: Daniel Baudin, Villarvolard, Switzerland

[73] Assignee: Harsco Corporation, Wormleysburg, Pa.

[21] Appl. No.: 945,600

[22] Filed: Sep. 16, 1992

Related U.S. Application Data

[63] Continuation of Ser. No. 743,341, Aug. 7, 1991, abandoned.

[30] Foreign Application Priority Data

Dec. 21, 1989 [IT] Italy ..... 68147 A

[51] Int. Cl.[5] ..... B61C 11/00

[52] U.S. Cl. ..... 105/31

[58] Field of Search ..... 105/30, 32, 31

[56] References Cited

U.S. PATENT DOCUMENTS

| | | | |
|---|---|---|---|
| 2,391,657 | 12/1945 | Tavelin | 105/31 |
| 2,473,109 | 6/1949 | Schneider | 105/31 X |
| 2,740,358 | 4/1956 | Philbrick | 105/30 |
| 2,941,481 | 6/1960 | Philbrick | 105/31 |
| 3,040,677 | 6/1962 | Creedle | 105/31 |
| 3,870,279 | 3/1975 | Century | 105/31 |
| 3,871,277 | 3/1975 | Bolton | 105/31 |

FOREIGN PATENT DOCUMENTS

| | | | |
|---|---|---|---|
| 0066433 | 12/1982 | European Pat. Off. . | |
| 202889 | 10/1908 | Fed. Rep. of Germany . | |
| 968587 | 2/1958 | Fed. Rep. of Germany | 105/32 |
| 40751 | 9/1987 | Fed. Rep. of Germany . | |

*Primary Examiner*—Robert J. Oberleitner
*Assistant Examiner*—S. Joseph Morano
*Attorney, Agent, or Firm*—Kerkam, Stowell, Kondracki & Clarke

[57] ABSTRACT

A propulsion device for a rail vehicle, such as a railway train, applies power for propulsion directly between the frame of the vehicle and the rails without intervention of wheels. The device includes articulated members for connecting the frame of the vehicle to the device, a hydraulic cylinder for displacing the device between a lifted neutralized position for normal travel and a lowered working position, and two movable cross-bars having jaws mounted at opposite ends thereof. Traction hydraulic cylinders connect each movable cross-bar and the vehicle frame. A hydraulic cylinder is used to engage and disengage the jaws to rails.

12 Claims, 3 Drawing Sheets

PROPULSION DEVICE FOR A TRAIN INTENDED FOR RENEWAL OF RAILWAY TRACKS UTILIZING RAIL GRIPPERS TO SUPPLY PROPULSION THRUST

This is a continuation of application Ser. No.. 07/743,341, filed Aug. 7, 1991 now abandoned.

TECHNICAL FIELD

The present invention refers to a propulsion device for a vehicle on rails, and mainly for a railway train intended for being used in conveying railway machinery or other machinery. More precisely the invention refers to a propulsion device of the kind in which the movement is obtained by applying the power needed for the propulsion directly between the frame of a vehicle and the rails, without intervention of the wheels.

PRIOR ART

There are known several types of vehicles or railway trains suitable for being conveyed on railways (by their own means or hooked to other trains) in order to displace them from a shed to a work place and, when reached this latter, to effect by mechanical means various operations such as, for example, the removal of rails to be replaced, the removal of old ties, the reclamation of the ballast, the laying of new ties, the laying of new rails, or even other operations. These trains should be provided with propulsion devices capable of ensuring a regular forward motion during the execution of the operations. The needed displacement is relatively slow, for example in the order of 10 meters for a minute, but it requires a high propulsion force, for example in the order of 200'000 N, in view of the great resistances which oppose to the forward motion during the work. For this reason it is not possible to use with advantage the usual propulsion means of the railway trains. To this purpose one can use propulsion devices with continual hydrostatic transmission, acting on the train wheels, but such devices involve high installation and exercise costs, and they give rise to adherence problems. As an alternative one can use propulsion devices with hydraulic cylinders operating without the intervention of the wheels by directly grasping the rails, but in their known embodiments such devices have the disadvantage that they cause an intermittent train motion, which is undesicapable for a regular development of the operations, or even they are not capable of effecting a reverse movement, which may be needed sometimes, even if only for a limited length, but with a frequent repetition.

SUMMARY OF THE INVENTION

The object of the present invention is to improve the propulsion devices for vehicles on rails of the last type stated above, and mainly the propulsion devices for railway trains intended for the purpose stated at the beginning, in such a way as to ensure, at the same time, favorable installation and exercise conditions, a continual and uniform propulsion at a speed which may be easily and exactly controlled, the availability of the high force needed without raising adherence problems, as well as the possibility of reversing the advancement direction without substantially modifying the characteristics of propulsion force and speed.

The propulsion device according to the present invention is mainly characterized in that it comprises articulated means for its connection to the frame of a railway vehicle, means for displacing the propulsion device between a lifted neutralized position for the transfer travel and a lowered working position, two movable cross-bars, means for supporting said movable cross-bars and for guiding them independently the one from the other along a displacement trajectory longitudinal with respect to the vehicle frame, traction hydraulic cylinders connected between each said movable cross-bar and the vehicle frame, jaws mounted at both ends of each movable cross-bar, suitable for engaging the corresponding rails, and actuation means provided for making active or inactive the engagement of the jaws with respect to the rails, in such a way that a propulsion force is produced, in progressive or regressive direction.

According to an embodiment particularly provided for, said jaws engage the rails by wedging and said actuation means operate by displacing said jaws with respect to the movable cross-bars in such a way that said wedging engagement is made active or inactive with respect to a progressive displacement or, respectively, to a regressive displacement of the vehicle.

Due to these characteristics, the propulsion device according to the invention may be lifted in a neutralized position for the transfer travel, which this way cannot be troubled, and successively it may be lowered at the proper time in order to ensure the train propulsion during the period in which it is working. When the propulsion device is in working position, the movable cross-bars may be alternatively rendered solid with the rails, by means of their respective engagement jaws, thus offering a fixed rest point which allows the traction hydraulic cylinders to transmit to the frame of the bearer vehicle (and hence to all the train to which it appertains) the desired propulsion force. During the time in which a first cross-bar is solid with the rails in the manner described in order to offer a rest points, the jaws of the second cross-bar may be disengaged from the rails and then the second cross-bar may be displaced forward by the corresponding traction cylinders, thus displacing the same in an advanced position, and when this latter has been reached the cross-bar may be rendered solid again with the rails in order to offer a new rest point. Thereafter the first cross-bar may be advanced in a similar manner after it has displaced backwards with respect to the advanced vehicle. By providing in the execution of these working steps a certain superposition of the push periods offered by the two cross-bars, it is possible to ensure a continue and uniform propulsion of the train. Due to the propulsion being effected by hydraulic cylinders, it is easy to obtain the high force needed without giving rise to adherence problems, as well as to easily and accurately controlling the advancement speed impressed to the train. Because the jaws of the cross-bars may be engaged with the rails in such conditions as to give rise to a propulsion force in the progressive or in the regressive direction it is also ensured the possibility of effecting reverse displacements when needed, with propulsion characteristics similar to those obtained in the forward movement. Finally, the proper character of the means used ensures the installation and exercise economy of the device.

The propulsion device according to the invention may be indifferently applied to any vehicle forming the working set of the train, or even to any store waggon being part of the same train. This latter possibility may be found advantageous in view of the great number of other apparatuses which should find place on the vehicles of the working set, and it depends on the fact that the adherence of the propulsion device, being caused by the engagement of the jaws with respect to the rails, does not depend on the weight of the vehicle on which the propulsion device is mounted.

Particular dispositions may be foreseen for ensuring the correct insertion of the movable cross-bars, with their jaws, in correspondence of the curves of the way, as well as for blocking the cross-bars in their positions of inactivity.

BRIEF DESCRIPTION OF THE DRAWINGS

The stated features and others, and the advantages of the subject of the invention, will appear more clearly from the following description of an embodiment, described by way of example and without any limiting purpose, and diagrammatically shown in the annexed drawings, wherein.

PREFERRED EMBODIMENT OF THE INVENTION

Taking reference for example to a train for renewal of railway tracks, such a train comprises in general a working set formed by one or several cars, further working means mounted on cars which follow the working set, and a certain number of store waggons intended to transport the new materials to be laid as well as to receive the old materials removed. Any one of all these cars, to which in this case the function of propelling the train is imparted, is shown in FIGS. 1 and 2.

Figure 1:
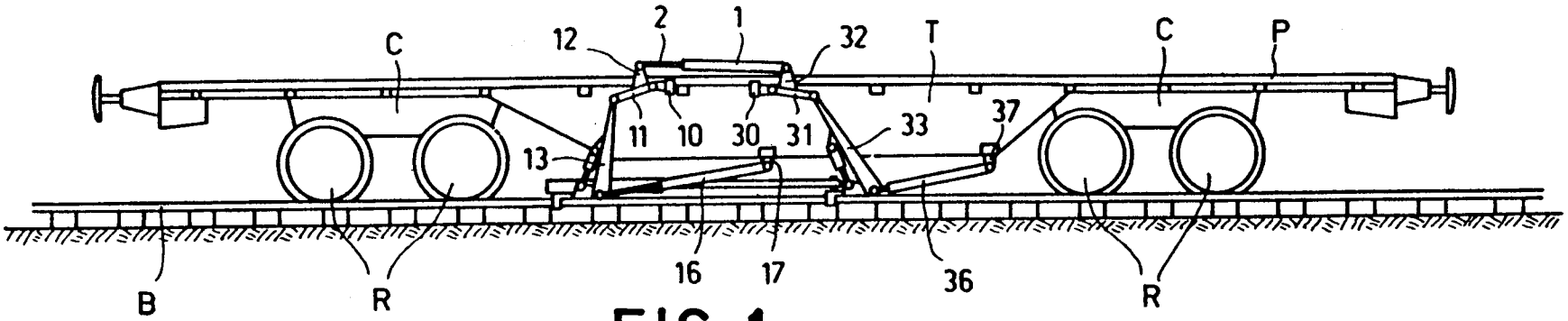
FIG. 1 shows in a side view and on a reduced scale a railway vehicle equipped with the propulsion device according to the invention, in its working position.
Figure 2:
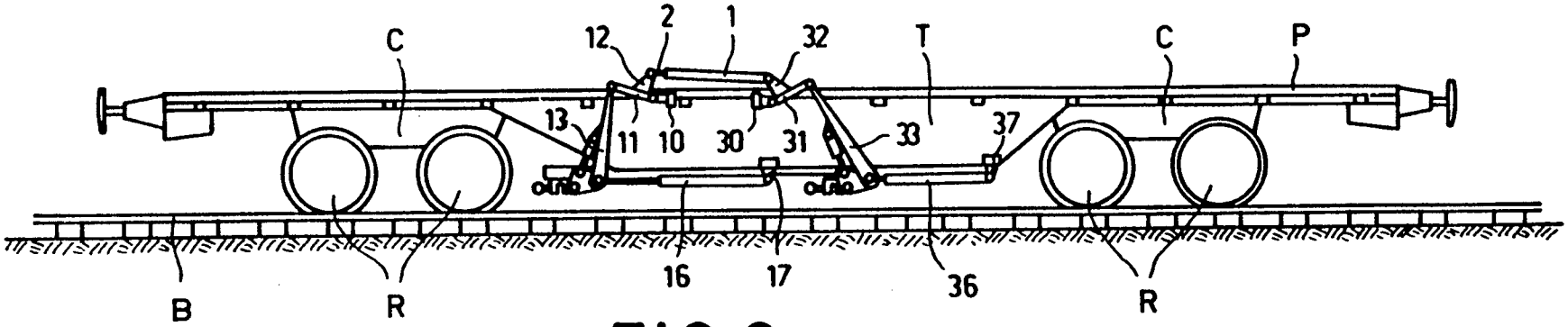
FIG. 2 shows in similar manner the vehicle of FIG. 1, but with the propulsion device in its neutralized position for transfer.

The car shown in FIGS. 1 and 2 comprises a frame T which in this case rests on wheels R by means of two bogies C. In other cases the bogies could be replaced by simple axles. The frame T carries on top a load platform P which may possibly be equipped with a service way for the displacement of the materials.

On each side of the car, the frame T has articulated in points 10 and 30 two supporting arms 11 and 31 which carry the propulsion device. The supporting arms 11 and 31 are provided with lever arms 12 and 32 forming square levers with the supporting arms. Between the supporting arms 12 and 32 there is mounted a hydraulic unit comprising a cylinder 1 and its piston stem 2. By this arrangement, when the hydraulic unit 1–2 is extended, the supporting arms 11 and 31 are lowered and the propulsion device takes a working position (FIG. 1), having the possibility of engaging the rails L of the railway. When, on the contrary, the hydraulic unit 1–2 is contracted, the supporting arms 11 and 31 are lifted (FIG. 2), and the propulsion device is completely situated above the level of the way B. In this position the propulsion device is inactive and it allows free circulation of the car on the railway for approaching the working place or departing from this latter On each side of the car, to each supporting arm 11 and 31 there is hanging a lever, respectively 13 and 33, which by means of a connecting rod, respectively 14 and 34, sustains a movable cross-bar, respectively a front cross-bar 15 and a rear cross-bar 35. To the bottom ends of the levers 13 and 33 are connected the stems of two hydraulic cylinders, respectively 16 and 36, articulated to points, respectively 17 and 37, which are fixed to the car frame T. As it may be understood, the activation of cylinders 16 allows displacing the levers 13, and with them the front cross-bar 15, between the position displaced forward, shown in the drawings, and a position 13' displaced rearward, shown by dot and dash lines in FIG. 3. In the same manner the activation of the hydraulic cylinders 36 allows displacing the levers 33, and with them the rear cross-bar 35, between the position displaced rearward, shown in the drawings, and a position 33' displaced forward, shown by dot and dash lines in FIG. 3.

Between the connecting rods 14 and the levers 13, as well as between the connecting rods 34 and the levers 33, there are inserted hydraulic cylinders, respectively 18 and 38, which allow to regulate the position of the connecting rods with respect to the corresponding levers. By a suitable control of the hydraulic cylinders 18 and 38 it is possible to obtain that the cross-bars 15 and 35, under action of cylinders 16 and 36, displace along trajectories substantially parallel to rails B, despite the bottom ends of levers 13 and 33 travelling along arcs of circle. This way it may be ensured that the engagement jaws, described later on and mounted at the ends of the movable cross-bars, remain against or strictly near the travel surface forming the top part of the rails.

Figure 5:
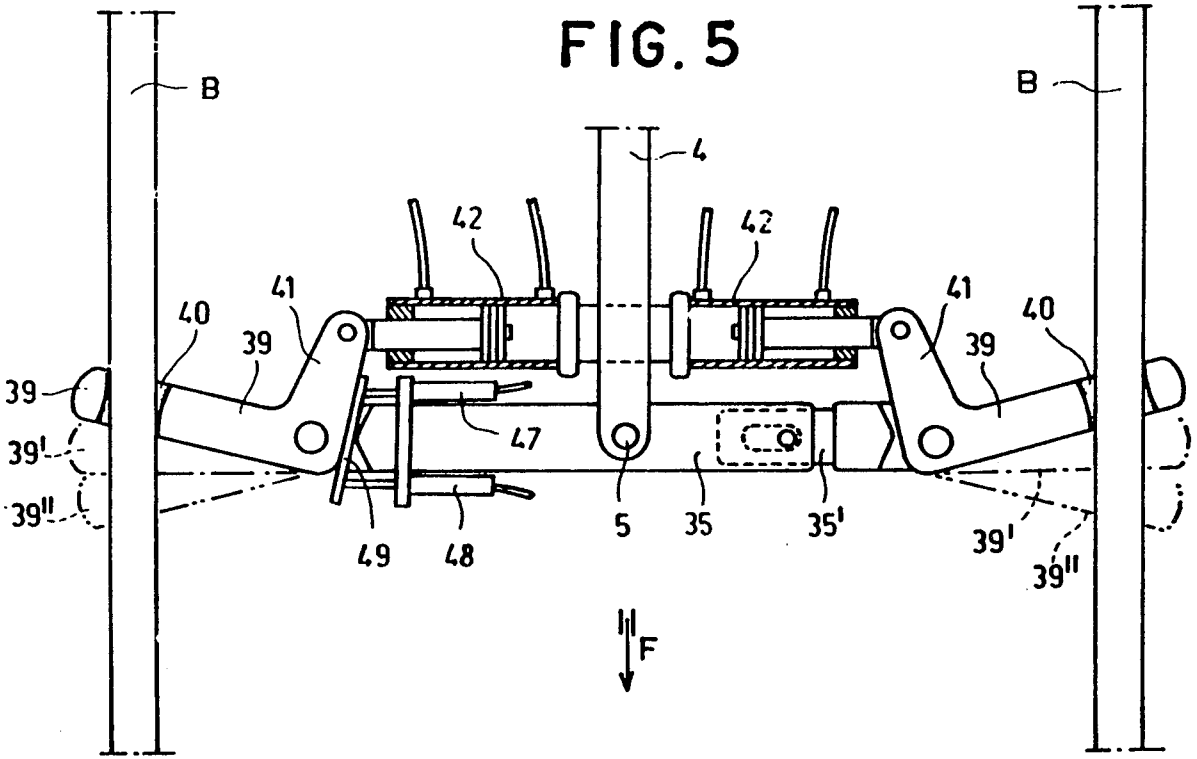
FIG. 5 shows on a larger scale a detail of a movable cross-bar, as viewed from bottom, with the respective jaws engaged with the heads of the rails.
Figure 6:
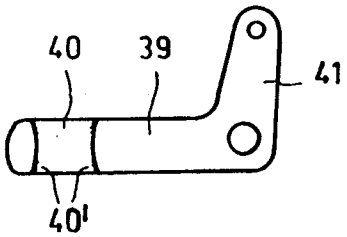
FIG. 6 shows singularly a jaw as seen from bottom.
Figure 7:
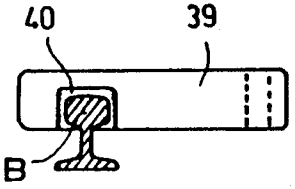
FIG. 7 shows in side view a jaw in condition of engagement with the respective rail.

To the ends of movable cross-bars 15 and 35 are articulated the jaws, respectively 19 and 39. In the embodiment presently described, these jaws are intended to engage the rails by wedging. To this purpose each jaw is provided with a recess, respectively 20 and 40, suitable for engaging the head of a rail B (FIGS. 5 to 7). The jaws 19 and 39 are provided with control arms, respectively 21 and 41, forming square levers with the jaws. Between the arms 21 of the front jaws 19 there is inserted a double hydraulic unit 22 with cylinders and pistons, and between the arms 41 of the rear jaws 39 there is inserted, in a similar manner, a double hydraulic unit 42 with cylinders and pistons. The hydraulic units 22 and 42 allow oscillating the jaws 19, respectively 39, with respect to the movable cross-bars 15 and 35 to which they appertain, as shown by FIG. 5. FIG. 5 particularly refers to the rear movable cross-bar, but a completely similar behavior is realized by the front movable cross-bar.

Taking reference to FIG. 5, when the jaws 39 have been displaced by the double hydraulic cylinder 42 in the position shown by solid lines, their recesses 40 engage the heads of rails B in such a position that a force, applied to the cross-bar 35 by the hydraulic cylinders 36 in the direction of arrow F, tends to increase the wedging between jaws 39 and rails B. Therefore in these conditions the action of the hydraulic cylinders 36 cannot displace the cross-bar 35 with respect to rails B, and on the contrary it causes advancing, in the direction opposite arrow F, the car to whose frame the cylinders 36 are articulated. It is then obtained a progressive motion of the car.

When, on the contrary, the jaws are displaced by the double hydraulic cylinder 42 in the position 39' shown by dot and dash lines, there is no wedging between the recesses 40 of jaws 39 and the rails B, and therefore the cross-bar 35 may be freely displaced with respect to the rails.

When, finally, the jaws 39 are displaced by the double hydraulic cylinder 42 in the position 39'' shown by lines with double dots and dashes, the recesses 40 engage the heads of rails B in such a position that a force, applied to the cross-bar 35 by the hydraulic cylinders 36 in the direction opposite arrow F, tends to increase the wedging between jaws 39 and rails B. Therefore in these conditions the action of the hydraulic cylinders 36 cannot displace the cross-bar 35 with respect to rails B, and on the contrary it causes advancing, in the direction of arrow F, the car to whose frame the cylinders 36 are articulated. It is then obtained a regressive motion of the car.

In order to render more sure the wedging with respect to rails B, the recess 40 of jaw 39 (as well as the recess 20 of jaw 19) may be provided with regions 40' (FIG. 6) which are furrowed, knurled or in any manner roughened, or are provided with a friction material. In order that it may conform to gauge differences in the rails B of the way, the cross-bar 35 is preferably provided with a telescopic joint 35' which allows a limited modification of its length, and a similar arrangement is taken for the front cross-bar 15. Finally, the cross-bars 15 and 35 are preferably connected the one another by a longitudinal bar comprising two parts 3 and 4 telescopically connected the one another, so that they allow independent displacements of the cross-bars in longitudinal direction. The cross-bars are articulated to said longitudinal bar 3–4 by pivots 5 arranged for allowing a limited angular orientation of the movable cross-bars, in order to ensure a correct engagement with respect to the rails B in correspondence of a curve of these latter.

The left part of FIG. 5 shows a safety device that may be advantageously adopted. This device comprises a pair of hydraulic units 47 and 48 with cylinder and piston, whose stems act on a plate 49 solid with jaw 39. The hydraulic units 47 and 48 are inactive during the propulsion step, and they are arranged in such a way that they compel jaw 39 to take the position 39', not engaged with rail B, when said units are activated. It is to be understood that such units are foreseen for all the jaws of the propulsion device. The actuation of these hydraulic units when the jaws 39 should be displaced along the rails B ensures that the jaws cannot accidentally wedge with the rails due to perturbations originated, for example, by deformations, crushes or flashes of the rails, by abnormal frictions or the like.

Figure 3:
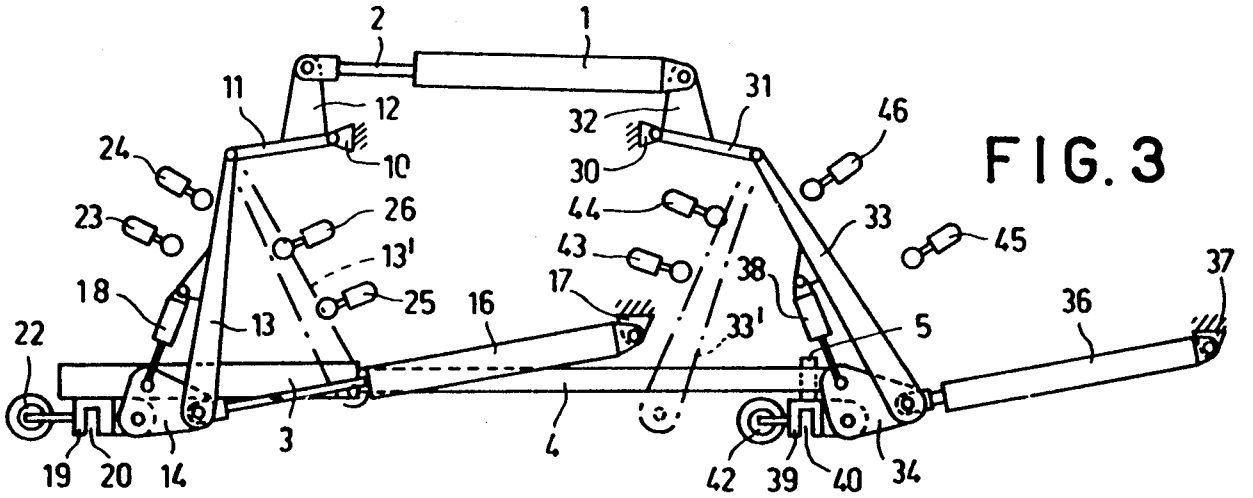
FIG. 3 shows on a larger scale and with more detail the propulsion device according to FIG. 1, separated from the vehicle.

In order to allow controlling automatically the actuation of the device, preferably this latter includes sensors which detect when the levers 13 and 33 reach particular positions. More in detail, as shown by FIG. 3, in connection with the front levers 13 may be foreseen the following sensors: 23, which detects the front lever 13 reaching its front position of end of stroke; 24, which detects reaching a position slightly foregoing that of end of stroke detected by sensor 23; 25, which detects the front lever 13 reaching its back position of end of stroke; and 26, which detects reaching a position slightly foregoing that of end of stroke detected by sensor 25. In a similar manner, in connection with the back levers 33 may be foreseen the following sensors: 43, which detects the back lever 33 reaching its front position of end of stroke; 44, which detects reaching a position slightly foregoing that of end of stroke detected by sensor 43; 45, which detects the back lever 33 reaching its back position of end of stroke; and 46, which detects reaching a position slightly foregoing that of end of stroke detected by sensor 45.

The actuation of the propulsion device according to the invention may take place as follows. After having completed a travel for approaching the train to a working place, this travel having been effected with the propulsion device lifted according to FIG. 2, the propulsion device is lowered according to FIG. 1 by actuating the hydraulic units 1–2, and by this operation the recesses 20 and 40 of the jaws 19 and 39 engage the heads of the corresponding rails B. Supposing to start from the configuration according to FIG. 3, the double hydraulic cylinder 22 is contracted whereas the double hydraulic cylinder 42 is brought to an intermediate position. In this manner the front jaws 19 are wedge engaged with the rails B, whereas the back jaws 39 are not wedged with respect to the rails.

The hydraulic cylinders 16 are then activated for expansion, whereas the hydraulic cylinders 36 are activated for retraction. Because the jaws 19 are wedge engaged with the rails B, the traction cylinders 16 cause the car to advance, and the levers 13 oscillate towards the position 13'. This displacement takes place with the controlled speed that should be imparted to the car and the train. Simultaneously, the cylinders 36 cause the levers 33 to oscillate towards the position 33', and the jaws 39, which are not wedged with respect to the rails B, displace forward with respect to the rails; this displacement may be rapid.

After the sensors 43 have detected the levers 33 reaching the front position of end of stroke, the action of cylinders 36 is interrupted. When, successively, the sensors 26 detect that levers 13 are near to the back position of end of stroke, the double cylinder 42 is activated for retraction, whereby the jaws 39 wedge with the rails, and the cylinders 36 are activated for retraction too, whereby they add their action to the action of cylinders 16 in producing the advancement of the car. The step during which cylinders 36 and cylinders 16 cause together the advancement is maintained only for a brief period in order to ensure the propulsion continuity. As soon as the sensors 25 have detected the levers 13 reaching their back position of end of stroke, the activation of cylinders 16 is inverted and the double cylinder 22 is brought to an intermediate position, whereby the propulsion by cylinders 16 ends, and these cylinders displace forward with respect to the rails the jaws 19, now no more wedged with the rails. The propulsion is now effected by cylinders 36 only.

When sensors 23 detect the front levers 13 reaching their front position of end of stroke, cylinders 16 are inactivated. When, successively, sensors 46 detect that levers 33 are near to the back position of end of stroke, the front cylinders 16 and 22 are brought again in the condition of propulsion, as at the start of the described cycle, whereby they add their action to the action of the traction cylinders 16. As soon as, finally, the sensors 45 have detected the levers 33 reaching their back position of end of stroke, the activation of cylinders 36 is inverted and the double cylinder 42 is brought to an intermediate position, whereby the repetition of the described cycle starts.

It is particularly to be remarked that the superposition, for a certain extension, of the propulsion steps actuated by the traction cylinders 16 and 36 ensures the possibility of obtaining a uniform advancement, free from any solution of continuity.

It will be clearly understood by those skilled in the art how the described cycle should be modified in order to obtain a retrograde advancement, instead of a progressive advancement, of the vehicle. To this purpose the double cylinders 22 and 42 are actuated, during the propulsion period, for expansion rather than for retraction, thus causing the jaws to oscillate to positions similar to those shown at 39" in FIG. 5. The superposition of the propulsion periods actuated by the front and the rear traction cylinders is possible thanks to the presence of sensors 24 and 44, which are not active during the progressive propulsion, whereas during the retrograde propulsion are not active the sensors 26 and 46.

Figure 8:
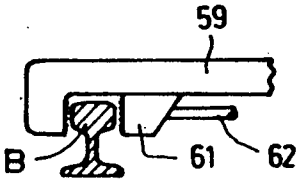

In the embodiment described so far, the jaws of the propulsion device engage the rails by wedging, tilting with respect to the cross-bars which carry them. However it is possible to foresee jaws acting in any other manner, particularly by grasping. For example, as shown by FIG. 8, a jaw may include a fixed part 59 and a part 61 which may displace in horizontal direction under action of a hydraulic unit, of which the piston stem is shown at 62. Such a jaw is capable of grasping the sides of a rail head B in order to realize the desired engagement.

Figure 4:
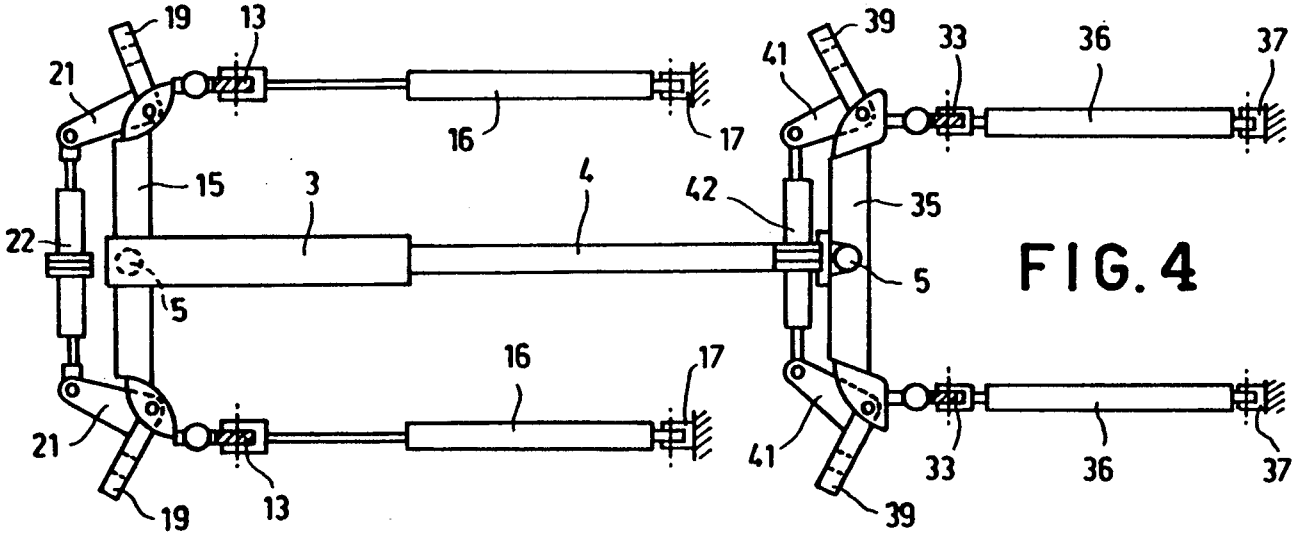
FIG. 4 shows in plan view the bottom part of the propulsion device according to FIG. 3.
Figure 9:
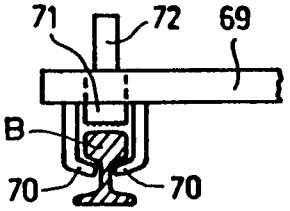
FIGS. 8 and 9 show two different exemplary embodiments of the jaws intended for engaging the rails.

As an alternative, as shown by FIG. 9, a jaw may include a fixed part 69 provided with members extending (in the working position) below the rail head B, and a part 71 which may displace in vertical direction under action of a hydraulic unit 72. Such a jaw is capable of grasping in vertical direction a rail head B in order to realize the desired engagement. It should be understood that, contrary to the embodiments according to FIGS. 4 and 5, in the embodiments such as those shows as examples in FIGS. 8 and 9 the jaws are not needed to be articulated at the ends of the movable cross-bars in order to oscillate with respect to the latter, but on the contrary they may be fixed with respect to the cross-bars.

The propulsion device described is simple, relatively unexpensive and extremely reliable, and it allows obtaining, by a minimal power consumption, the high forces needed, by realizing an uninterrupted advancement which may be either progressive or regressive, at a uniform speed which may be controlled in exact manner. Because the propulsion device, free from adherence problems, may be applied to a store waggon rather than to a car of the working set of the train, it allows in certain cases rendering the renewal train, in its whole, more light, simple and economical. However it is clear that, when this appears more suitable, the propulsion device may also be applied to one of the cars of the working set of the train.

In the foregoing, a train for renewal of railway tracks has been discussed, because it represents the typical application of the propulsion device according to the invention, but it should be understood that this device may be generally applied to the propulsion of any vehicle on rails. It should also be understood that the device according to the invention may show all the described features or only a part of these features, according to the specific need of any envisaged application. Various modifications may be brought to the described details, and all parts and groups may be replaced by technically equivalent means, within the field of the claims of this patent.

POSSIBLE INDUSTRIAL APPLICATIONS

The propulsion device according to the invention may find advantageous applications on any railway vehicle which requires an advancement relatively slow, uniform, under a high traction force. The more characteristic application is to the propulsion of a train intended for effecting operations on a railway.

I claim:

1. A propulsion device for a railway vehicle comprising:

an articulated means for connecting the device to a railway vehicle frame;

displacing means for displacing the device between the lower working position and an upper storage position, said displacing means connected to said articulated means;

two movable cross-bars having opposite ends for positioning adjacent opposite rails of a railway track, said articulated means including members supporting said cross-bars for movement of each cross-bar independently of the other cross-bar along a displacement trajectory longitudinal with respect to the railway vehicle frame;

traction hydraulic cylinders for connecting each cross-bar to the vehicle frame;

jaws mounted at said opposite ends of each cross-bar for engaging the opposite rails, the jaw at one of said ends of each cross-bar positioned to engage a different rail from the rail engaged by the jaw at an opposite end of said each cross bar;

actuating means for engaging and disengaging the jaws with respect to the rails, said traction hydraulic cylinders operable to move the railway vehicle along the rails when said jaws engage the rails; a telescopic longitudinal bar having opposite ends pivotably connected to said crossbars; and wherein said displacing means is a hydraulic cylinder which lowers both cross-bars simultaneously.

2. The propulsion device of claim 1 wherein both of said cross-bars are between front and back wheels of the railway vehicle.

3. The propulsion device of claim 1 mounted to a vehicle frame.

4. The propulsion device of claim 1 wherein said articulated means comprises for each cross-bar, an assembly having at least one support arm, at least one lever having an upper end pivotably mounted to said support arm and a lower end, and at least one connecting rod pivotably connected to said lower end of said lever, and wherein said displacing means lowers said cross-bars by pivoting said support arms to lower said levers and in turn lower said connecting rods.

5. A propulsion device for a railway vehicle comprising:

an articulated means for connecting the device to a railway vehicle frame;

displacing means for displacing the device between a lower working position and an upper storage position, said displacing means connected to said articulated means;

two movable cross-bars having opposite ends for positioning adjacent opposite rails of a railway track, said articulated means including members supporting said cross-bars for movement of each cross-bar independently of the other cross-bar along a displacement trajectory longitudinal with respect to the railway vehicle frame;

traction hydraulic cylinders for connecting each cross-bar to the vehicle frame;

jaws mounted at said opposite ends of each cross-bar for engaging the opposite rails, the jaw at one of said ends of each cross-bar positioned to engage a different rail from the rail engaged by the jaw at an opposite end of said each cross bar;

actuation means for engaging and disengaging the jaws with respect to the rails, said traction hydraulic cylinders operable to move the railway vehicle along the rails when said jaws engage the rails; and a telescopic longitudinal bar having opposite ends pivotably connected to said cross-bars.

6. The propulsion device of claim 5 wherein said longitudinal bar is pivotably connected to centers of said cross-bars.

7. The propulsion device of claim 6 wherein said articulated means comprises, for each cross-bar an assembly having at least one support arm, at least one lever having an upper end pivotably mounted to said support arm and a lower end, and at least one connecting rod pivotably connected to said lower end of said lever, and wherein said displacing means lowers said cross-bars by pivoting said support arms to lower said levers and in turn lower said connecting rods.

8. A propulsion device for a railway vehicle comprising:

an articulated means or connecting the device to a railway vehicle frame;

displacing means for displacing the device between a lower working position and an upper storage position, said displacing means connected to said articulated means;

two movable cross-bars having opposite ends for positioning adjacent opposite rails of a railway track, said articulated means including members supporting said cross-bars for movement of each cross-bar independently of the other cross-bar along a displacement trajectory longitudinal with respect to the railway vehicle frame;

traction hydraulic cylinders for connecting each cross-bar to the vehicle frame; jaws mounted at said opposite ends of each cross-bar for engaging the opposite rails, the jaw at one of said ends of each cross-bar positioned to engage a different rail from the rail engaged by the jaw at an opposite end of said each cross bar;

actuating means for engaging and disengaging the jaws with respect to the rails, said traction hydraulic cylinders operable to move the railway vehicle along the rails when said jaws engage the rails; and wherein said articulated means comprises for each cross-bar, an assembly having at least one support arm, at least one lever having an upper end pivotably mounted to said support arm and a lower end, and at least one connecting rod pivotably connected to said lower end of said lever, and wherein said displacing means lower said cross-bars by pivoting said support arms to lower said levers and in turn lower said connecting rods.

9. The propulsion device of claim 8 further comprising a telescopic longitudinal bar having opposite ends pivotably connected to said cross-bars.

10. The propulsion device of claim 9 wherein said displacing means is a hydraulic cylinder which lowers both cross-bars simultaneously.

11. A propulsion device for a railway vehicle comprising:

an articulated means for connecting the device to a railway vehicle frame;

displacing means for displacing the device between a lower working position and an upper storage position, said displacing means connected to said articulated means;

two movable cross-bars having opposite ends for positioning adjacent opposite rails of a railway track, said articulated means including members supporting sad cross-bars for movement of each cross-bar independently of the other cross-bar along a displacement trajectory longitudinal with respect to the railway vehicle frame;

traction hydraulic cylinders for connecting each cross-bar to the vehicle frame;

jaws mounted at said opposite ends of each cross-bar for engaging the opposite rails, the jaw at one of said ends of each cross-bar positioned to engage a different rail from the rail engaged by the jaw at an opposite end of each cross-bar;

actuation means for engaging and disengaging the jaws with respect to the rails, said traction hydraulic cylinders operable to move the railway vehicle along the rails when said jaws engage the rails; and wherein each of said jaws have opposing rail-engaging faces which are fixed relative to each other, and further comprising jaw actuating means for orienting said jaws in either a wedging state or a non-wedging state by pivoting said jaws about vertical axes.

12. A propulsion device for a railway vehicle comprising:

an articulated means for connecting the device to a railway vehicle frame;

displacing means or displacing the device between a lower working position and an upper storage position, said displacing means connected to said articulated means;

two movable cross-bars having opposite ends for positioning adjacent opposite rails of a railway track, said articulated means including members supporting said cross-bars for movement of each cross-bar independently of the other cross-bar along a displacement trajectory longitudinal with respect to the railway vehicle frame;

traction hydraulic cylinders for connecting each cross-bar to the vehicle frame;

jaws mounted at said opposite ends of each cross-bar for engaging the opposite rails, the jaw at one of said ends of each cross-bar positioned to engage a different rail from the rail engaged by the jaw at an opposite end of each cross-bar;

actuating means for engaging and disengaging the jaws with respect to the rails, said traction hydraulic cylinders operable to move the railway vehicle along the rails when said jaws engage the rails; and wherein each of said cross-bars is telescopically adjustable in length such that said jaws mounted at said opposite ends of said cross-bars are spaced differently for different gauge rails.

* * * * *

UNITED STATES PATENT AND TRADEMARK OFFICE

CERTIFICATE OF CORRECTION

PATENT NO. : 5,261,331

DATED : November 16, 1993

INVENTOR(S) : Daniel BAUDIN

It is certified that error appears in the above-identified patent and that said Letters Patent is hereby corrected as shown below:

Column 8, line 36 (Claim 1), change "actuating" to -- actuation --;

Column 9, line 34 (Claim 8), change "or" to -- for --;

Column 9, line 55 (Claim 8), change "actuating" to -- actuation --;

Column 9, line 66 (Claim 8), change "lower" to -- lowers --;

Column 10, line 18 (Claim 11), change "sad" to -- said --;

Column 10, line 42 (Claim 12), change "or" to -- for --;

Column 10, line 60 (Claim 12), change "actuating" to -- actuation --.

Signed and Sealed this

Seventeenth Day of May, 1994

Bruce Lehman

*Attest:*

BRUCE LEHMAN

*Attesting Officer*

*Commissioner of Patents and Trademarks*